US008747645B2

(12) United States Patent
Stecker et al.

(10) Patent No.: US 8,747,645 B2
(45) **Date of Patent: *Jun. 10, 2014**

(54) PROCESS FOR PREPARING UNSYMMETRICAL BIARYL ALCOHOLS

(75) Inventors: Florian Stecker, Mannheim (DE); Andreas Fischer, Heppenheim (DE); Itamar Michael Malkowsky, Hassloch (DE); Siegfried R. Waldvogel, Bonn (DE); Axel Kirste, Swisttal (DE)

(73) Assignee: BASF SE, Ludwigshafen (DE)

( * ) Notice: Subject to any disclaimer, the term of this patent is extended or adjusted under 35 U.S.C. 154(b) by 254 days.

This patent is subject to a terminal disclaimer.

(21) Appl. No.: 13/375,100

(22) PCT Filed: Jun. 1, 2010

(86) PCT No.: PCT/EP2010/057619

§ 371 (c)(1),
(2), (4) Date: Nov. 29, 2011

(87) PCT Pub. No.: WO2010/139687

PCT Pub. Date: Dec. 9, 2010

(65) Prior Publication Data

US 2012/0067736 A1 Mar. 22, 2012

(30) Foreign Application Priority Data

Jun. 5, 2009 (EP) ..... 09162076

(51) Int. Cl.

| | |
|---|---|
| ***C25B 3/10*** | (2006.01) |
| ***C25B 3/00*** | (2006.01) |
| ***C25B 3/02*** | (2006.01) |

(52) U.S. Cl.
USPC ..... 205/418; 205/450; 205/452; 205/453

(58) Field of Classification Search
USPC ..... 205/418, 450, 452, 453
See application file for complete search history.

(56) References Cited

U.S. PATENT DOCUMENTS

| | | | | |
|---|---|---|---|---|
| 4,101,391 | A | 7/1978 | Hallcher | 204/59 R |
| 8,449,755 | B2 * | 5/2013 | Fischer et al. | 205/418 |
| 2011/0147228 | A1 | 6/2011 | Fischer et al. | 205/418 |
| 2012/0080320 | A1 * | 4/2012 | Fischer et al. | 205/418 |

FOREIGN PATENT DOCUMENTS

| | | | | |
|---|---|---|---|---|
| DE | 27 00 152 | | 7/1977 | |
| DE | 196 41 344 | | 4/1997 | |
| EP | 08163356 | | 9/2008 | |
| WO | 2005 075709 | | 8/2005 | |
| WO | 2006 077204 | | 7/2006 | |
| WO | WO 2006077204 | A2 * | 7/2006 | C25B 3/10 |
| WO | WO 2007131969 | A2 * | 11/2007 | C25B 3/06 |
| WO | 2010 023258 | | 3/2010 | |

OTHER PUBLICATIONS

Kirste et al., "ortho-Selective Phenol-Coupling Reaction by Anodic Treatment on Boron-Doped Diamond Electrode Using Fluorinated Alcohols" (Jan. 29, 2009), Chem. Eur. J., vol. 15, pp. 2273-2277.*

Axel Kirste, et al., "Anodic Preparation of Biphenols on BDD electrodes", 59th Annual Meeting of the International Society of Electrochemistry, Sep. 7-12, 2008, 1 page (submitting abstract only).

"Electrochemistry", Ullmann'S Encyclopedia of Industrial Chemistry, Chap. 3.5, 5.4.3.2, 2005, pp. 1-2, 29-34, 99-103.

Kirste, A., et al., "*ortho*-Selective Phenol-Coupling Reaction by Anodic Treatment on Boron-Doped Diamond Electrode Using Fluorinated Alcohols," Chem. Eur. J., vol. 15, pp. 2273-2277, (Jan. 29, 2009) XP002595229.

Kirste, A., et al., "Anodic Phenol-Arene Cross-Coupling Reaction on Boron-Doped Diamond Electrodes," Angew. Chem. Int. Ed., vol. 49, No. 5, pp. 971-975, (Dec. 22, 2009) XP002595230.

International Search Report Issued Aug. 20, 2010 in PCT/EP10/057619 Filed Jun. 1, 2010.

U.S. Appl. No. 13/375,495, filed Dec. 1, 2011, Fischer, et al.

* cited by examiner

*Primary Examiner* — Edna Wong

(74) *Attorney, Agent, or Firm* — Oblon, Spivak, McClelland, Maier & Neustadt, L.L.P.

(57) ABSTRACT

The invention relates to a process for preparing unsymmetrical biaryl by anodic dehydrodimerization of substituted ortho-alkoxyaryl alcohols in the presence of partially fluorinated and/or perfluorinated mediators and a supporting electrolyte.

20 Claims, No Drawings

PROCESS FOR PREPARING UNSYMMETRICAL BIARYL ALCOHOLS

The invention relates to a process for preparing unsymmetrical biaryl alcohols by anodic dehydrodimerization of substituted ortho-alkoxyaryl alcohols in the presence of partially fluorinated and/or perfluorinated mediators and a supporting electrolyte.

Biaryls are known as such and are used industrially. Compounds such as 3,3',5,5'-tetramethylbiphenyl-2,2'-diol are of very great interest as backbones for ligands. One possible route to this class of substances is (electrochemical) oxidative dimerization of phenols. However, this often proceeds unselectively.

It has been able to be shown that symmetrical phenol coupling can be achieved at boron-doped diamond electrodes (BDD) using supporting electrolytes and fluorinated mediators, as described by A. Kirste, M. Nieger, I. M. Malkowsky, F. Stecker, A. Fischer, S. R. Waldvogel in Chem. Eur. J. 2009, 15, 2273, and in WO-A 2006/077204. A process for preparing unsymmetrical biaryl alcohols is not described.

Selective and efficient symmetrical biphenol coupling of, for example, 2,4-dimethyl-phenol can be achieved using other carbon electrodes and also fluorinated carboxylic acids as mediators. The solvent-free process requires only undivided electrolysis cells, as described by A. Fischer, I. M. Malkowsky, F. Stecker, A. Kirste, S. R. Waldvogel in Anodic Preparation of Biphenols on BDD electrodes and EP-A 08163356.2. The use of a diamond electrode as anode for the preparation of the unsymmetrical biaryl compounds has not been described here.

It is an object of the present invention to provide a process by means of which the selective and efficient anodic dehydrodimerization of substituted ortho-alkoxyaryl alcohols to form unsymmetrical biaryl alcohols is made possible.

This object is achieved by a process for preparing unsymmetrical biaryl alcohols, wherein substituted ortho-alkoxyaryl alcohols are anodically dehydrodimerized in the presence of partially fluorinated and/or perfluorinated mediators and at least one supporting electrolyte.

The process of the invention is advantageous when the OH group of the ortho-alkoxyaryl alcohols used is bound directly to the aromatic.

The process of the invention is advantageous when the substituted ortho-alkoxyaryl alcohols used are identical.

The process of the invention is advantageous when the substituted ortho-alkoxyaryl alcohols used are monocyclic or bicyclic.

The process of the invention is advantageous when the dimerization takes place in the ortho position relative to one alcohol group and in the meta position relative to the other alcohol group of the ortho-alkoxyaryl alcohols.

The process of the invention is advantageous when the mediators used are partially fluorinated and/or perfluorinated alcohols and/or acids.

The process of the invention is advantageous when 1,1,1,3,3,3-hexafluoroisopropanol and/or trifluoroacetic acid are used as mediators.

The process of the invention is advantageous when salts selected from the group consisting of alkali metal, alkaline earth metal, tetra($C_1$-$C_6$-alkyl)ammonium salts are used as supporting electrolytes.

The process of the invention is advantageous when the counterions of the supporting electrolytes are selected from the group consisting of sulfate, hydrogensulfate, alkylsulfates, arylsulfates, halides, phosphates, carbonates, alkylphosphates, alkylcarbonates, nitrate, alkoxides, tetrafluoroborate, hexafluorophosphate and perchlorate.

The process of the invention is advantageous when no further solvent is used for the electrolysis.

The process of the invention is advantageous when a nickel cathode is used.

The process of the invention is advantageous when a flow cell is used for the electrolysis.

The process of the invention is advantageous when current densities of from 1 to 1000 mA/cm$^2$ are used.

The process of the invention is advantageous when the electrolysis is carried out at temperatures in the range from −20 to 100° C. and atmospheric pressure.

The process of the invention is advantageous when 4-methylguaiacol is used as ortho-alkoxyaryl alcohol.

The process of the invention is advantageous when the anode is selected from the group consisting of graphite and boron-doped diamond electrodes.

For the purposes of the present invention, an ortho-alkoxyaryl alcohol is an aromatic alcohol which is substituted by an alkoxy group in the ortho position and in which the hydroxyl group is bound directly to the aromatic ring.

The aromatic on which the ortho-alkoxyaryl alcohol is based can be monocyclic or polycyclic. The aromatic is preferably monocyclic (phenol derivatives) as per formula I or bicyclic (naphthol derivatives) as per formula II, with particular preference being given to monocyclic aromatics.

I

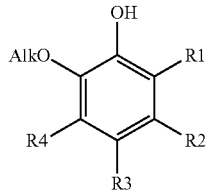

II

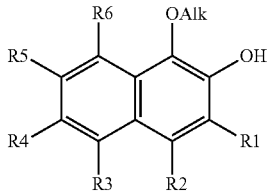

The alkoxy group (OAlk) of the ortho-alkoxyaryl alcohols which are used in the process of the invention is a $C_1$-$C_{10}$-alkoxy group, preferably methoxy, ethoxy, n-propoxy, i-propoxy, n-butoxy, i-butoxy, tert-butoxy, particularly preferably methoxy, ethoxy, n-propoxy, very particularly preferably methoxy.

The ortho-alkoxyaryl alcohols can bear further substituents R1 to R6. These substituents R1 to R6 are selected independently from the group consisting of $C_1$-$C_{10}$-alkyl groups, halogens, $C_1$-$C_{10}$-alkoxy groups, alkylene or arylene radicals interrupted by oxygen or sulfur, $C_1$-$C_{10}$-alkoxycarboxyl, nitrile, nitro and $C_1$-$C_{10}$-alkoxycarbamoyl groups. The substituents are preferably selected from the group consisting of methyl, ethyl, n-propyl, isopropyl, n-butyl, trifluoromethyl, fluorine, chlorine, bromine, iodine, methoxy, ethoxy, methylene, ethylene, propylene, isopropylene, benzylidene, nitrile, nitro. The substituents are particularly preferably selected from the group consisting of methyl, methoxy, methylene, ethylene, trifluoromethyl, fluorine and bromine.

The unsymmetrical biaryl alcohol is prepared electrochemically, with the corresponding ortho-alkoxyaryl alcohol being anodically oxidized. The process of the invention will hereinafter be referred to as electrodimerization. It has surprisingly been found that the process of the invention using mediators forms the unsymmetrical biaryl alcohols selectively and in high yield. Furthermore, it has been found that the process of the invention enables undivided cell constructions and solvent-free processes to be employed.

The work-up and isolation of the unsymmetrical biaryl alcohols is very simple. After the reaction is complete, the electrolyte solution is worked up by general separation methods. For this purpose, the electrolyte solution is in general firstly distilled and the individual compounds are obtained separately in the form of various fractions. Further purification can be carried out, for example, by crystallization, distillation, sublimation or chromatography.

Electrodes selected from the group consisting of iron, steel, stainless steel, nickel, noble metals such as platinum, graphite, carbon materials such as the diamond electrodes are suitable for the process of the invention. These diamond electrodes are formed by applying one or more diamond layers to a support material. Possible support materials are niobium, silicon, tungsten, titanium, silicon carbide, tantalum, graphite or ceramic supports such as titanium suboxide. However, a support composed of niobium, titanium or silicon is preferred for the process of the invention, and very particular preference is given to a support composed of niobium when a diamond electrode is used. The anode is preferably selected from the group consisting of graphite and diamond electrodes, with the diamond electrode also being able to be doped with further elements. Preferred doping elements are boron and nitrogen. Very particular preference is given to the process of the invention using a boron-doped diamond electrode (BDD electrode) as anode.

The cathode material is selected from the group consisting of iron, steel, stainless steel, nickel, noble metals such as platinum, graphite, carbon materials and diamond electrodes. The cathode is preferably selected from the group consisting of nickel, steel and stainless steel. The cathode is particularly preferably composed of nickel.

Preferred electrode material combinations for anode and cathode are a combination of graphite anode and nickel cathode and also the combination of boron-doped diamond anode and nickel cathode.

In the process of the invention, partially fluorinated and/or perfluorinated alcohols and/or acids, preferably perfluorinated alcohols and carboxylic acids, very particularly preferably 1,1,1,3,3,3-hexafluoroisopropanol or trifluoroacetic acid, are used as mediators.

No further solvents are necessary in the electrolyte.

The electrolysis is carried out in the customary electrolysis cells known to those skilled in the art. Suitable electrolysis cells are known to those skilled in the art. The process is preferably carried out continuously in undivided flow cells or batchwise in glass beaker cells.

Very particular preference is given to bipolar capillary gap cells or stacked plate cells in which the electrodes are configured as plates and are arranged in parallel, as described in Ullmann's Encyclopedia of Industrial Chemistry, 1999 electronic release, Sixth Edition, Wiley-VCH-Weinheim, (doi: 10.1002/14356007.a09_183.pub2) and in Electrochemistry, Chapter 3.5. special cell designs and also Chapter 5, Organic Electrochemistry, Subchapter 5.4.3.2 Cell Design.

The current densities at which the process is carried out are generally 1-1000 mA/cm$^2$, preferably 5-100 mA/cm$^2$. The temperatures are usually from −20 to 100° C., preferably from 10 to 60° C. The process is generally carried out at atmospheric pressure. Higher pressures are preferably used when the process is to be carried out at higher temperatures in order to avoid boiling of the starting compounds or cosolvents or mediators.

To carry out the electrolysis, the ortho-alkoxyaryl alcohol compound is dissolved in a suitable solvent. Suitable solvents are the customary solvents known to those skilled in the art, preferably solvents from the group consisting of polar protic and polar aprotic solvents. The ortho-alkoxyaryl alcohol compound itself particularly preferably serves as solvent and reagent.

Examples of polar aprotic solvents comprise nitriles, amides, carbonates, ethers, ureas, chlorinated hydrocarbons. Examples of particularly preferred polar aprotic solvents comprise acetonitrile, dimethylformamide, dimethyl sulfoxide, propylene carbonate and dichloromethane. Examples of polar protic solvents comprise alcohols, carboxylic acids and amides. Examples of particularly preferred polar protic solvents comprise methanol, ethanol, propanol, butanol, pentanol and hexanol. These can also be partially or fully halogenated, e.g. 1,1,1,3,3,3-hexafluoroisopropanol (HFIP) or trifluoroacetic acid (TFA).

If appropriate, customary cosolvents are added to the electrolysis solution. These are the inert solvents having a high oxidation potential which are customary in organic chemistry. Examples which may be mentioned are dimethyl carbonate, propylene carbonate, tetrahydrofuran, dimethoxyethane, acetonitrile and dimethylformamide.

Supporting electrolytes comprised in the electrolysis solution are in general alkali metal, alkaline earth metal, tetra($C_1$-$C_6$-alkyl)ammonium, preferably tri($C_1$-$C_6$-alkyl)-methylammonium, salts. Possible counterions are sulfates, hydrogensulfates, alkylsulfates, arylsulfates, halides, phosphates, carbonates, alkylphosphates, alkylcarbonates, nitrate, alkoxides, tetrafluoroborate, hexafluorophosphate or perchlorate.

Furthermore, the acids derived from the abovementioned anions are possible as supporting electrolytes.

Very particular preference is given to methyltributylammonium methylsulfate (MTBS), methyltriethylammonium methylsulfate (MTES), methyltripropylmethylammonium methylsulfate or tetrabutylammonium tetrafluoroborate (TBABF).

EXAMPLES

Tables with Reactions

Example 1

Anodic oxidation of 4-methylguaiacol at a BDD anode using hexafluoroisopropanol (HFIP)

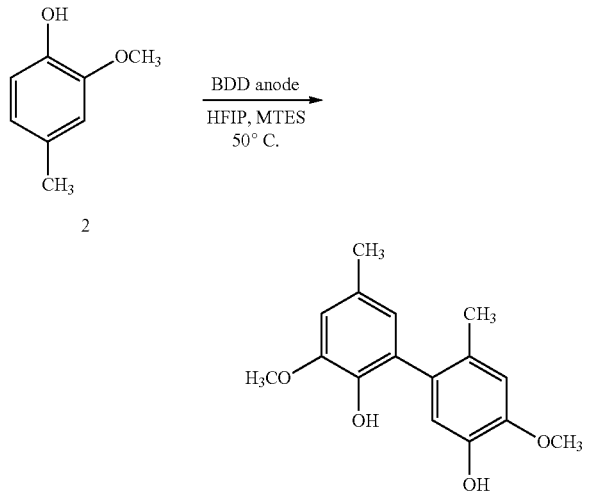

The electrolyte comprising 2.76 g of 4-methylguaiacol, 0.68 g of methyltriethylammonium methylsulfate (MTES)

and 30 ml of hexafluoroisopropanol (HFIP) as per table 1 is placed in an electrolysis cell to which a BDD-coated silicon plate connected as anode is applied via a flange. The anode surface is completely covered by electrolyte. As cathode, use is made of a nickel mesh which is immersed in the electrolyte at a distance of 1 cm from the BDD anode. The cell is heated in a sand bath (50° C.). The electrolysis is carried out under galvanostatic control and at current densities of 2.8-9.5 mA/cm$^2$. The reaction is stopped after the set charge limit (1 F per mole of 4-methylguaiacol) has been reached. The cooled reaction mixture is transferred with the aid of about 20 ml of toluene into a flask from which toluene and the fluorinated solvent used are virtually completely removed on a rotary evaporator. Excess phenol can be recovered by means of short path distillation at $1.0\times10^{-1}$ mbar and 125° C. Purification of the distillation residue by column chromatography on silica gel 60 (CH:EE=4:1) and subsequent washing with a little cold n-heptane enables the product to be isolated as a colorless, crystalline solid (0.90 g).

$R_F$ value (CH:EE=2:1): 0.33; 1H NMR (300 MHz, $CDCl_3$) δ=6.80 (s, 1H), 6.76 (s, 1H), 6.68 (d, J=1.7, 1H), 6.56 (d, J=1.7, 1H), 5.28 (s, 2H), 3.90 (s, 6H), 2.30 (s, 3H), 2.13 (s, 3H); $^{13}$C-NMR (100 MHz, $CDCl_3$): δ=$^{13}$C NMR (75 MHz, $CDCl_3$) δ=146.25, 145.80, 143.21, 140.41, 130.00, 128.70, 128.32, 127.37, 123.34, 116.15, 112.29, 110.54, 55.95, 55.89, 21.06, 19.49.

TABLE 1

Reaction of 4-methylguaiacol (MG) at BDD using HFIP [a].

| Electrolyte | T [° C.] | $U_{max}$ [V] | F [1/mol] | j [mA/cm$^2$] | Y [%] | CY [%] |
|---|---|---|---|---|---|---|
| 2.76 g of MG/ 0.68 g of MTES/ 30 ml of HFIP | 50 | 5 | 1.0 | 2.8 | 27 | 27 |
| 2.76 g of MG/ 0.68 g of MTES/ 30 ml of HFIP | 50 | 12 | 1.0 | 4.7 | 33 | 33 |
| 2.76 g of MG/ 0.68 g of MTES/ 30 ml of HFIP | 50 | 7 | 1.0 | 9.5 | 14 | 14 |

[a] HFIP: 1,1,1,3,3,3-hexafluoroisopropanol
Y: yield
CY: current yield

TABLE 2

Reaction of further guaiacol derivatives at BDD using HFIP.

| Electrolyte | T [° C.] | $U_{max}$ [V] | F [1/mol] | j [mA/cm$^2$] | Y [%] | CY [%] |
|---|---|---|---|---|---|---|
| 3.17 g of 4-chloroguaiacol/ 0.68 g of MTES/ 30 ml of HFIP | 50 | 7 | 1.0 | 4.7 | 6 | 6 |
| 4.06 g of 4-bromoguaiacol/ 0.68 g of MTES/ 30 ml of HFIP | 50 | 6 | 1.0 | 4.7 | 7 | 7 |
| 2.43 g of 4-methoxyguaiacol/ 0.68 g of MTES/ 30 ml of HFIP | 50 | 8 | 1.0 | 2.8 | 25[a] | 25 |

[a]based on total product: a symmetrical 3,3'-dihydroxy-1,1'-biphenyl and the unsymmetrical biphenyl are formed in the ratio 2.5:1; separation of the isomers has not yet been possible.
Y: yield
CY: current yield

The invention claimed is:

1. A process for preparing an unsymmetrical biaryl alcohol, the process comprising anodically dehydrodimerizing, by electrolysis, one or two monocyclic or bicyclic substituted ortho-alkoxyaryl alcohols of which an alcohol group is bound directly to an aromatic ring thereof, in the presence of at least one mediator selected from the group consisting of a partially fluorinated mediator and a perfluorinated mediator and a supporting electrolyte, wherein the monocyclic substituted ortho-alkoxyaryl alcohol may comprise R1 to R4 as a substituent and the bicyclic substituted ortho-alkoxyaryl alcohol may comprise R1 to R6 as a substituent, and wherein R1 to R6 are independently selected from the group consisting of a $C_1$-$C_{10}$-alkyl group, a halogen, alkyl(-{S or O}-alkylene)-, aryl(-{S or O}-arylene)-, a $C_1$-$C_{10}$-alkoxycarboxyl, a nitrile, a nitro, and a $C_1$-$C_{10}$-alkoxycarbamoyl group.

2. The process of claim 1, wherein only one monocyclic or bicyclic substituted ortho-alkoxyaryl alcohol is employed in the dehydrodimerizing.

3. The process of claim 1, wherein the dehydrodimerizing takes place in an ortho position relative to the alcohol group of a first monocyclic or bicyclic substituted ortho-alkoxyaryl alcohol and in the meta position relative to the alcohol group of a second monocyclic or bicyclic substituted ortho-alkoxyaryl alcohol.

4. The process of claim 1, wherein the mediator is at least one selected from the group consisting of a partially fluorinated alcohol, a perfluorinated alcohol, a partially fluorinated acid, and a perfluorinated acid.

5. The process of claim 1, wherein the mediator is at least one selected from the group consisting of 1,1,1,3,3,3-hexafluoroisopropanol and trifluoroacetic acid.

6. The process of claim 1, wherein the supporting electrolyte is a salt selected from the group consisting of an alkali metal, an alkaline earth metal, and a tetra($C_1$-$C_6$-alkyl)ammonium salt.

7. The process of claim 1, wherein a counterion of the supporting electrolyte is selected from the group consisting of sulfate, hydrogensulfate, an alkylsulfate, an arylsulfate, a halide, a phosphate, a carbonate, an alkylphosphate, an alkylcarbonate, nitrate, an alkoxide, tetrafluoroborate, hexafluorophosphate, and perchlorate.

8. The process of claim 1, wherein no further solvent is employed for the dehydrodimerizing.

9. The process of claim 1, wherein a nickel cathode is employed for the dehydrodimerizing.

10. The process of claim 9, wherein a graphite anode is employed in the dehydrodimerizing.

11. The process of claim 9, wherein a boron-doped diamond anode is employed in the dehydrodimerizing.

12. The process of claim 1, wherein the dehydrodimerizing is carried out in a flow cell.

13. The process of claim 1, wherein a current density of from 1 to 1000 mA/cm$^2$ is employed in the dehydrodimerizing.

14. The process of claim 1, wherein the dehydrodimerizing is carried out at a temperature in a range from −20 to 100° C. and at atmospheric pressure.

15. The process of claim 1, wherein the monocyclic or bicyclic substituted ortho-alkoxyaryl alcohol is 4-methylguaiacol.

16. The process of claim 1, wherein an anode employed in the dehydrodimerizing is at least one selected from the group consisting of graphite, a carbon material, and a boron-doped diamond electrode.

17. The process of claim 1, wherein a current density of from 5 to 100 $mA/cm^2$ is employed in the dehydrodimerizing.

18. The process of claim 1, wherein the dehydrodimerizing is carried out at a temperature in a range from 10 to 60° C. and at atmospheric pressure.

19. The process of claim 1, wherein the mediator is 1,1,1,3,3,3-hexafluoroisopropanol.

20. The process of claim 1, wherein the mediator is trifluoroacetic acid.

* * * * *